United States Patent [19]
Visconti
[11] 4,295,347
[45] Oct. 20, 1981

[54] SIMULATED GEM

[76] Inventor: James Visconti, 55 W. 28th St., New York, N.Y. 10001

[21] Appl. No.: 909,347

[22] Filed: May 25, 1978

[51] Int. Cl.[3] ..... A44C 17/00
[52] U.S. Cl. ..... 63/32; 63/DIG. 3; 428/15; 428/28
[58] Field of Search ..... 63/32, DIG. 3; 428/15-28; 156/61; 206/223, 575; 427/268, 274, 281, 263

[56] References Cited

U.S. PATENT DOCUMENTS

| | | | |
|---|---|---|---|
| 1,254,791 | 1/1918 | Ganzinotti | 428/15 X |
| 1,745,607 | 2/1930 | D'Esposito | 428/15 X |
| 2,270,210 | 1/1942 | Barbieri | 63/32 |
| 2,270,270 | 1/1942 | Clare | 63/32 |
| 2,353,995 | 7/1944 | Conner | 428/357 |
| 2,366,244 | 1/1945 | Ellerstein | 428/15 X |
| 2,927,039 | 3/1960 | Vander Weel | 428/488 X |
| 3,340,087 | 9/1967 | Mazzola | 427/281 |
| 3,539,379 | 11/1970 | Mayer | 428/15 X |
| 4,030,317 | 6/1977 | Rogell | 428/15 X |

*Primary Examiner*—Henry F. Epstein
*Attorney, Agent, or Firm*—M. Arthur Auslander

[57] ABSTRACT

A simulated gem is made by lacquering a plastic core to a desired pattern with selected lacquer to interfuse the surface of the core to form a unitary article. The core and lacquer have a common solvent. The solvent must not overdissolve the core.

3 Claims, 7 Drawing Figures

SIMULATED GEM

The present invention relates to a simulated gem and kit for making such gem and process of making the gem.

The present invention comes in a kit form and is designed to enable both the skilled and unskilled to create gem-like objects which may be used in costume jewelery or as desired, such gems having both beauty and stamina. The present invention further achieves this end result both speedily and economically with great flexibility.

The making of simulated or artificial gems has been carried on in many ways and by many techniques in the past. Various simulated or artificial gems have been made in the past by mixing colored glasses or by coating on substances to form a desired gem design, or by molding colored substances in a desired form or by enameling.

According to the present invention, a composite simulated gem is produced as from a kit as an article of manufacture and by a method whereby a plastic core or core may be selectively decorated with lacquer or lacquers of more than one hue, then pushed free of the lacquer puddle to dry. The end product is a durable composite gem resistant to surface cracking or peeling.

The core and the lacquer must be somewhat intersoluble, generally having a common solvent so the surface of the core and the coating of lacquer superficially interfuse. The end product gem is a unitary product from which the lacquer coating is not likely to peel. The steps in coating and allowing the coated core to dry free of the lacquer puddle substantially results in a smooth, substantially bubble free gem outer surface.

In kit form, a large variety of simulated gems may be easily and quickly made.

Although such novel feature or features believed to be characteristic of the invention are pointed out in the claims, the invention and the manner in which it may be carried out may be further understood by reference to the description following and the accompanying drawings.

Referring now to the figures in greater detail, where like reference numbers denote like parts in the various figures.

Figure 1:
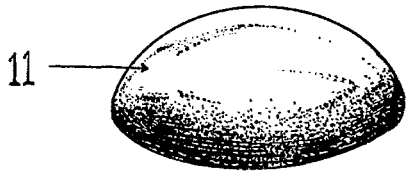
FIG. 1 is a plastic slug of the present invention.
Figure 2:
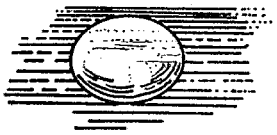
FIG. 2 is a flat surface and a drop of lacquer to receive the plastic core of FIG. 1.

The stimulated gem 10 of the present invention comprises a core 11 which is placed on a drop of lacquer such as shown in FIG. 2.

Figure 4:
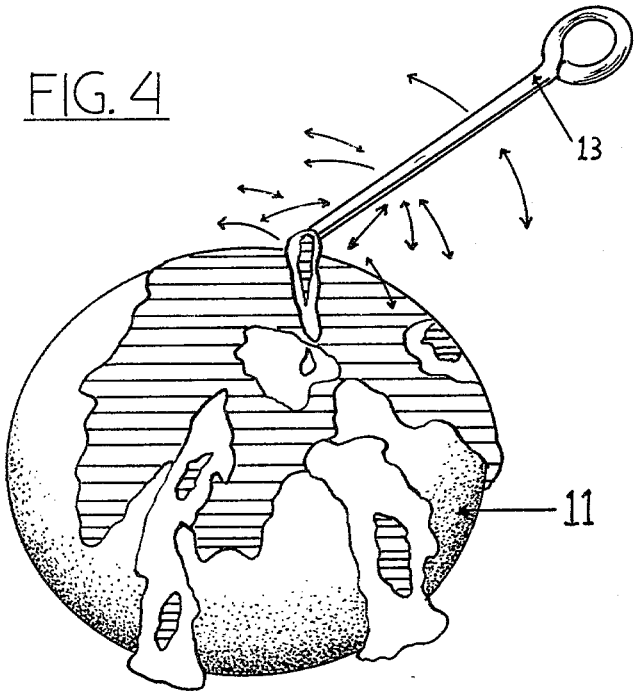
FIG. 4 shows designing of the selected lacquers of FIG. 3.

Once in place on top of the lacquer, additional drops of lacquer of selected hues are dripped from a brush 12 over the core 11. It is preferable that each lacquer hue have separate brushes 12 to avoid undesired color intermixtures. Once the lacquers have been applied, the core 11 and its lacquer drops are mixed, using a spatula 13 as shown in FIG. 4.

The initial drop of lacquer as shown in FIG. 2 holds the core 11 so that it will not slip away when being manipulated, particularly by the spatula 13.

Figure 5:
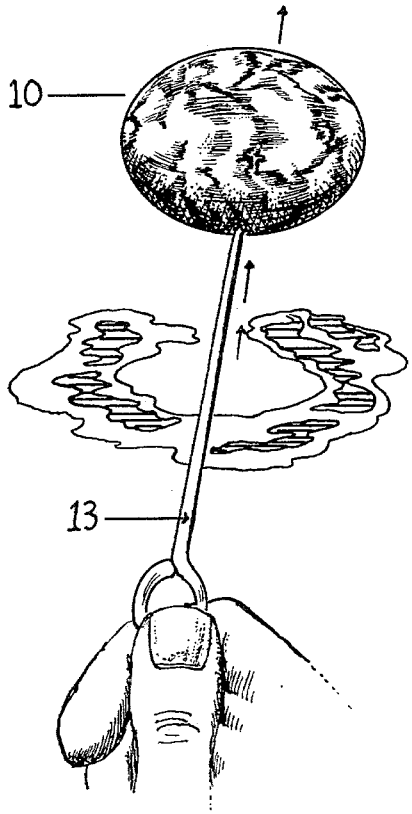
FIG. 5 shows the covered core of FIG. 4 moved free of the lacquer puddle.
Figure 6:
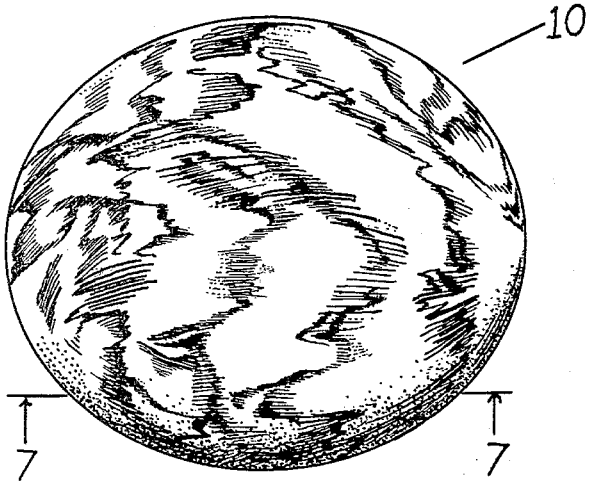
FIG. 6 is a completed simulated gem made in accordance with the present invention.
Figure 7:
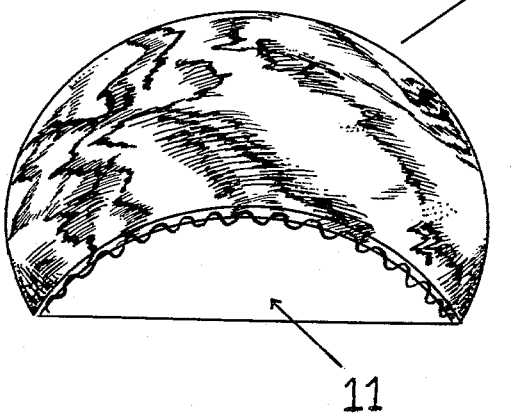
FIG. 7 is a section of FIG. 6 along lines 7—7.

The spatula 13 may be used to manipulate the core 11 with the lacquer and to set up desired designs or patterns of lacquer on the core 11. Once the core 11 has been covered and an optional design pattern achieved, the core 11 is pushed from the pool of lacquer, dripping from it as shown in FIG. 5, and allowed to dry.

It is preferable to allow the completed core 11 to dry overnight and that it not be touched while drying.

The surface tension of the lacquer usually causes the simulated gem 10 to dry with a smooth even surface, having the contour of the core and free from bubbles.

For best results, it is preferable that the core 11 be placed on a drop of lacquer which is on a flat surface as shown in FIG. 2. A preferable surface is a calendered surface or a glossy plastic surface insoluble in the lacquer.

When the core 11 has been worked on a flat calendered surface or a flat plastic insoluble surface and the core 11 moved free of the lacquer puddle where it has been worked, the core 11 is ready to dry as a unitary gem 10. The lacquer on the core 11, free of the puddle substantially conforms to the shape of the core 11. When dry, a simple prying removes the completed gem 10 from its drying surface.

Once the lacquer has dried on the core 11, the gem 10 may be gone over with a fine sandpaper to smooth any bubbles that may have occurred in its surface. Then the gem 10 may be buffed to polish it to a shine.

A final step may be taken to provide beauty, durability and depth. Clear lacquer may be brushed on the gem 10, coating the entire gem 10. This will further cover any bubble pocks which may have originally occurred.

The core 11 may be of selected peripheral shapes, but it is preferable that it have a symmetrical upper surface with no concavities since the lacquer might tend to puddle in the concavities or drip away from sharp edges. The underside of the core is preferably flat, or at least having the edge surfaces of the underside of the core 11 on a single plane so the slug 11 can rest flat on the surface where it is worked. The shape of the gem as described, and shown in the figures is defined as a cabochon.

A flat surface such as an uncalendered cardboard may be used, but upon removal of the dried gem 10, undesired fibre may stick to the undersurface of the completed gem 10. When this occurs, the fibre may be removed by using sandpaper or steel wool.

When desired, the undersurface of the core 11 may be colored or patterned. This can be done after the worked core 11 has dried. Hues then may be dripped or applied to the underside, then allowed to dry. In applying hues to the bottom the core 11 may also be hand held or imbedded in clay for stability.

A finished underside of the core 11 has little importance where a kit is provided with finger ring or pendant settings, since the gem 10 may be bonded to such setting without any exposure of the underside of the core 11.

The present invention is preferably in a kit form to enable even the unskilled to produce a gem of a satisfactory pattern. It is distinguished from the simple coloring or enameling, or painting of a core by virtue of the composite end products being unitary as distinguished from being coated. The surface of the gem 10 is also substantially nonpeelable and noncrackable.

The composite gem 10 is brought about by selecting the core 11 from a plastic that is soluble in the same solvent found in the lacquer. The lacquer selected must further not dissolve much more than the surface of the core 11, lest the slope of the core 11 be distorted.

A typical satisfactory lacquer-core 11 combination is found where the core 11 is made of Lucite or Plexiglas, which are trademarks for acrylic resins and lacquer formulated for ordinary nail polish. Such combination works satisfactorily without need for a special lacquer formulation.

Polyethylene cores 11 are satisfactory, as well as impregnated fibreglass.

The importance of the superficial interfusability is that the lacquer on the core 11 in whatever form or design that is allowed to dry, dries in the form of a unitary gem 10 which appears to have a design or to be colored or marbled through the depth of the gem 10. The interfusability also prevents peeling so that the end product gem 10 maintains the unitary composite appearance.

The unitary appearance of the gem 10 further has the advantage of being formed on a selected shape cabochon without the necessity of molding and without the need to make a solid lacquer build up.

The design on the gem 10 of the present invention is a function of the selection of lacquers applied to the core 11 and how they are patterned, such as by use of the spatula 13 or other optional means. There are unlimited hues that can be used as well as highlights of color with opalescent dust in the lacquer.

Once the plastic for the core 11 has been selected by means well known in the art, a lacquer formulation may be selected to interdissolve only with the surface of the core 11 without overdissolving the shape of the core 11, if such core 11 overdissolves with nail polish type lacquer.

Figure 3:
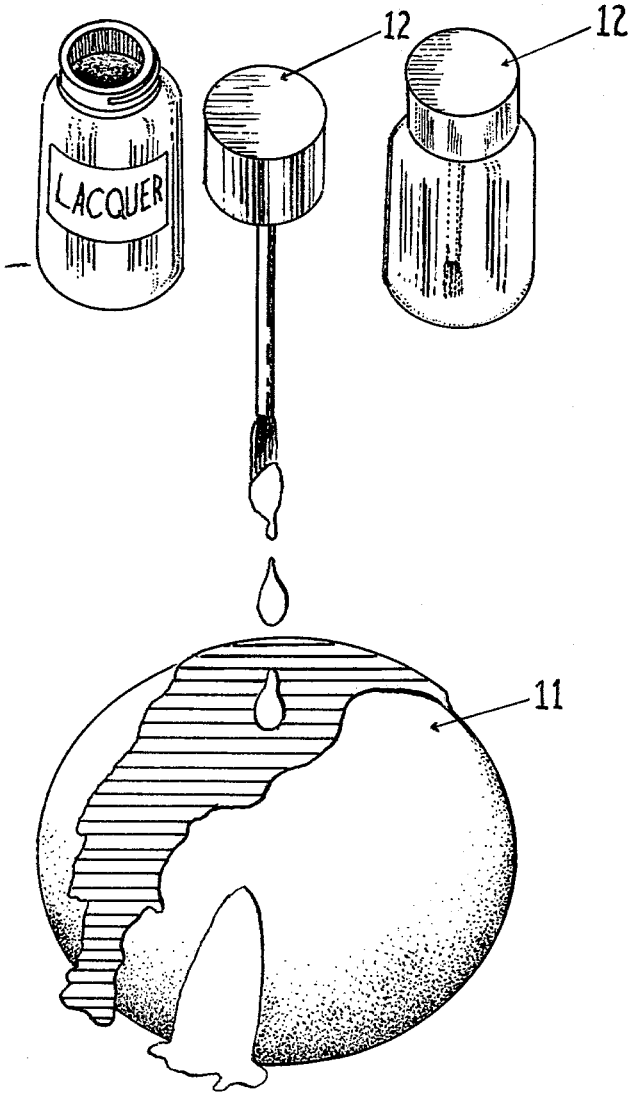
FIG. 3 shows a selection of lacquers and the dripping of lacquers of different hue on the plastic core of FIG. 1.

In kit form, a selection of shaped cores 11, a selection of lacquers as shown in FIG. 3, a flat calendered cardboard such as shown in FIG. 2 and a manipulating tool such as the spatula 13 as shown in FIG. 4, enables the making of selected designed gems 10.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A simulated gem of lacquer and plastic comprising a plastic core and a lacquer coating, said lacquer covering at least the entire outer surface of said core, said lacquer coating including a plurality of hues, said lacquer of said coating when in liquid state having a solvent adapted to superficially interfuse with the surface of said plastic core, said plastic core having a least the periphery of its underside on a single plane and substantially no upper surface concavities, and in the shape of a cobochon said lacquer coating marbled and interfused with the surface of said plastic core when in solid state, whereby the illusion of a solid unitary gem is created.

2. The invention of claim 1 wherein said plastic core is solid.

3. The invention of claim 2 wherein the underside of said core is flat.

* * * * *